US008199945B2

(12) United States Patent
Kornagel

(10) Patent No.: US 8,199,945 B2
(45) Date of Patent: Jun. 12, 2012

(54) HEARING INSTRUMENT WITH SOURCE SEPARATION AND CORRESPONDING METHOD

(75) Inventor: Ulrich Kornagel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1456 days.

(21) Appl. No.: 11/787,690

(22) Filed: Apr. 17, 2007

(65) Prior Publication Data

US 2007/0253573 A1 Nov. 1, 2007

(30) Foreign Application Priority Data

Apr. 21, 2006 (DE) ..... 10 2006 018 634

(51) Int. Cl.
*H04R 25/00* (2006.01)

(52) U.S. Cl. ..... 381/313; 381/312; 381/315; 381/92; 381/23.1

(58) Field of Classification Search ..... 381/23.1, 381/312–331, 92
See application file for complete search history.

(56) References Cited

U.S. PATENT DOCUMENTS

| | | | | |
|---|---|---|---|---|
| 5,479,522 | A * | 12/1995 | Lindemann et al. | 381/23.1 |
| 5,737,430 | A * | 4/1998 | Widrow | 381/313 |
| 6,766,029 | B1 * | 7/2004 | Maisano | 381/313 |
| 7,076,072 | B2 * | 7/2006 | Feng et al. | 381/313 |
| 7,319,769 | B2 * | 1/2008 | Allegro-Baumann et al. | 381/312 |
| 7,457,426 | B2 * | 11/2008 | Drtina | 381/313 |
| 2003/0138116 | A1 | 7/2003 | Jones et al. | |
| 2003/0185411 | A1 | 10/2003 | Atlas et al. | |
| 2005/0141736 | A1 | 6/2005 | Beimel et al. | |

FOREIGN PATENT DOCUMENTS

| | | | |
|---|---|---|---|
| DE | 10145994 | A1 | 4/2003 |
| EP | 1538874 | A2 | 6/2005 |
| WO | WO 0001200 | A1 * | 1/2000 |
| WO | 0187011 | A2 | 11/2001 |

* cited by examiner

*Primary Examiner* — Curtis Kuntz
*Assistant Examiner* — Ryan Robinson

(57) ABSTRACT

The selection of a plurality of sound sources for the purposes of preferential presentation should be structured to be more convenient for hearing instrument wearers. For this purpose, provision is made to separate the signals of the plurality of sources picked up and present them one after another with the aid of a corresponding control unit. On the basis of the presentation, the user can, likewise by means of the control units, select one of the plurality of signals for the purposes of further processing. The selection is preferably effected by pressing a button or by looking in the direction of the desired source plus pressing a button by way of acknowledgment.

18 Claims, 1 Drawing Sheet

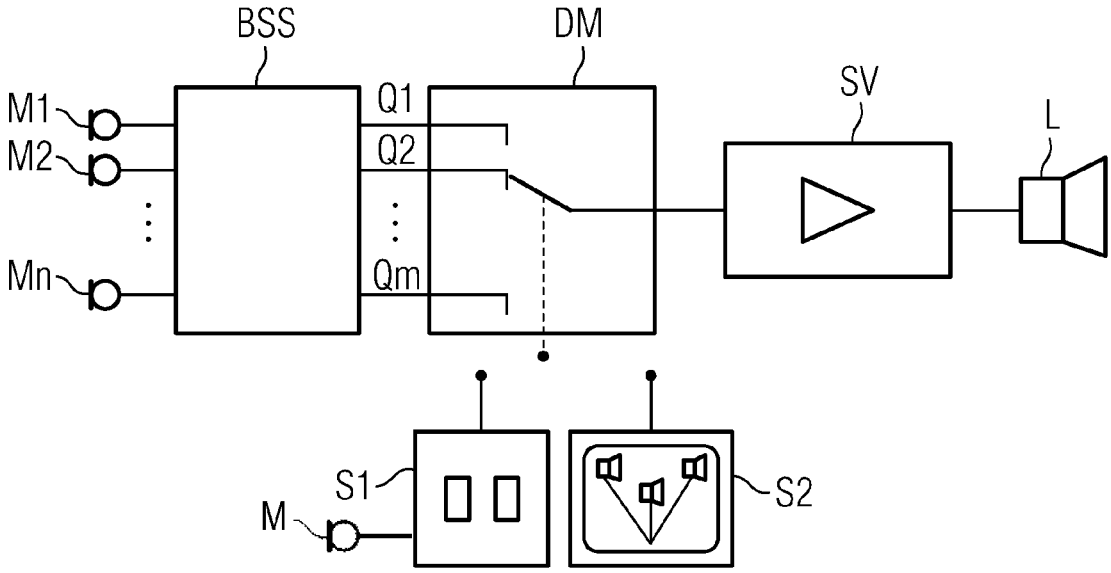
BSS
DM
SV
L
M1
M2
Mn
Q1
Q2
Qm
S1
S2
M

HEARING INSTRUMENT WITH SOURCE SEPARATION AND CORRESPONDING METHOD

CROSS REFERENCE TO RELATED APPLICATIONS

This application claims priority of German application No. 10 2006 018 634.6 filed Apr. 21, 2006, which is incorporated by reference herein in its entirety.

FIELD OF THE INVENTION

The present invention relates to a hearing instrument with a source separation device for receiving a hybrid signal from a plurality of sound sources and for generating a plurality of source-specific receive signals from same.

BACKGROUND OF THE INVENTION

A central issue for hearing instrument wearers is understanding speech in an environment with a plurality of sound sources. A situation of this type arises, by way of example, at a party at which numerous guests are talking at the same time and with approximately the same loudness. This problem is therefore designated as the so-called "cocktail party problem".

One possibility of improving the intelligibility of speech consists in employing a directional microphone. In this respect, the hearing instrument wearer has to look in the direction from which he wishes to receive sound preferentially. A disadvantage of this solution, however, is the fact that the head must not be turned away from the source. It therefore lacks flexibility. Apart from this, a plurality of sources may lie in the range of angles in which the directional microphone is sensitive.

An alternative method is known from telephone technology. In this case, signals from sources coming from different directions can be separated from the overall signal mix with the aid of so-called BSS technology (blind source separation). By way of example, three speakers are taking part in a telephone conference in one room. It is then possible with BSS technology to make three different channels available on which one speaker is transmitted preferentially in each case.

A method for separating sources is known from the publication US 2003/0185411 A1, in which the signals of different sources can be presented separately. The user can then select the desired source.

SUMMARY OF THE INVENTION

The object of the present invention therefore consists in improving the perceptibility of a desired source for the user of a hearing instrument.

According to the invention, this object is achieved in accordance with the claims by means of a hearing instrument with a source separation device for receiving at least one hybrid signal from a plurality of sound sources and for generating a plurality of source-specific receive signals from same, and also a presentation device for presenting one corresponding output signal in each case in relation to each of the plurality of input signals, and a selection device for the selection of one of the plurality of input signals by a user for the purposes of further processing. A piece of angle information about a receive angle is provided in relation to each of the plurality of receive signals by the source separation device. On the basis of the piece of angle information, the user can identify the desired source more rapidly. The plurality of output signals are then presented by the presentation device as a function of the associated receive angles. The user can orient himself more easily as a result of this, because the sources can always be presented in a fixed sequence from left to right, by way of example.

A relevant method in accordance with the claims is furthermore provided according to the invention.

The idea underlying the invention is that it cannot be automatically clarified, following a separation of the sources in the case of a hearing instrument, which of them should be presented preferentially. According to the invention, the hearing instrument wearer can then switch to one of the channels provided in order to be able to listen to the corresponding source.

The selection device is preferably connected wirelessly to the presentation device. In particular, the hearing apparatus can have a hearing instrument remote control facility, the selection device being integrated into the hearing instrument remote control facility. By means of the hearing instrument remote control facility, a source can be selected in a convenient manner.

In a specific embodiment, the hearing apparatus can have a housing, it being possible to register a knocking on the housing as a selection signal with the selection device. By means of this arrangement of the hearing apparatus, it is possible to omit a switch as an operating element, by way of example.

In an advantageous manner, the separated sources can be presented separately in succession according to the invention. The successive presentation produces the advantage for the user that he gets all the sources presented without having to act in a concentrated manner himself, in particular without eye contact with a switch unit. The output signals can preferably be presented in a predefined time sequence by the presentation device. By this means, the user can be saved from making manual switching operations.

A further preferred embodiment consists in the selection device possessing a display unit, on which sound sources can be represented graphically as a function of the respective receive angles. By means of the graphic representation, some users can orient themselves better and more quickly.

Moreover, an alignment of the hearing apparatus to one of the sound sources can be registered automatically as a selection signal, on the basis of the pieces of angle information provided, by the source separation device. As a result, no specific operating element for manual operation is needed on the hearing apparatus.

If no angle information is provided by the source separation device, it is necessary for the hearing apparatus to have a directional microphone, so that an alignment of the hearing apparatus to one of the sound sources can be registered automatically as a selection signal for the selection device. In this case also, the user is spared a manual operation.

BRIEF DESCRIPTION OF THE DRAWINGS

The present invention will now be explained in more detail with reference to the accompanying drawing, which shows a schematic circuit diagram of a hearing apparatus according to the invention.

DETAILED DESCRIPTION OF THE INVENTION

The exemplary embodiments described in more detail in the following represent preferred embodiments of the present invention.

The hearing instrument according to the invention shown in the FIG possesses a plurality of input-side microphones M1, M2, . . . , Mn. Each of the microphone signals consists of a hybrid signal, which is caused by a plurality of signal sources. A BSS unit connected to the microphones carries out an automatic source separation. The BSS unit accordingly makes source-specific output signals Q1, Q2, . . . , Qm available. A demultiplexer DM connected downstream of the BSS unit is used for the purposes of selecting one of the output signals Q1 to Qm, which preferentially contain the switching signal of one of the sound sources in each case. The output signal of the demultiplexer DM is fed to a customary signal processing unit SV. Its output signal is in turn routed to a loudspeaker L.

For the purposes of selecting the desired source signal Q1 to Qm, the demultiplexer DM is activated by a control device S1 and/or S2. These control devices are used both as a presentation device, i.e. for presenting each source signal Q1 to Qm one after another, and as a selection device for selecting a desired source signal on the basis of a presentation of the individual signals one after another. In accordance with a first embodiment, the demultiplexer DM is activated with the aid of a control unit S1, which possesses one or more buttons. As a result, the user can, by way of example, change the presentation sequence and select a source signal by pressing a button.

In accordance with a further embodiment, the demultiplexer DM is activated by a control unit S2, which possesses a display. The sources identified are represented on the display. Where relevant, pieces of angle information regarding an angle, by way of example, between a switching source and a 0° direction are also reproduced graphically or numerically. With the aid of this graphic reproduction, the hearing instrument wearer can envisage the different sources better and, by means of comparison with the real sources, he can make a selection more easily. Other operating interfaces can also be used in principle as a control unit.

It should therefore be possible for the source selection to be performed manually by the hearing instrument wearer by means of an operating interface or operating device. An external device, by way of example, can be considered as the operating device, such as e.g. the hearing instrument remote control facility or a mobile telephone upgraded to include this operating function, a corresponding portable computer or the hearing instrument itself.

The desired source is selected by the hearing instrument wearer by means of each source being presented to him preferentially, i.e. with increased level, in succession by the hearing instrument(s). The hearing instrument wearer acknowledges the source that he wants by means of the operating device. In the simplest case, it is possible to switch from one source to the next by pressing a button. By way of example, the switching is effected by pressing a button or knocking on the hearing instrument, if same is being used as an operating device.

In the event that the BSS system also supplies the angle information in relation to the individual sources (DOA estimation=direction of arrival estimation), the sources can be presented already sorted in a defined angular direction, in succession, in the selection process. By way of example, the angular direction can be defined as clockwise or anti-clockwise. But a switchover of the angular direction can also be enabled in order to better accommodate the needs of the user.

In the case of the exemplary embodiment with the control device S2, the operating device possesses a display function, so that the positions of the sources found can be visualized. If a touch screen is used, then the selection can be effected directly via the screen. For this purpose, however, it is necessary for the positional information for the sources to be transmitted to the operating device in advance.

Alternatively, the desired source can also be selected by means of the wearer of the hearing instrument or hearing apparatus looking in the direction of the desired source. In this case, the control of the demultiplexer is carried out directly by the BSS unit. In this case, however, by way of example, the BSS unit has to be informed by pressing a button that the desired source, which then lies in the 0° direction, should be selected. Following this semi-automatic selection operation, the hearing instrument wearer no longer has to look constantly at the desired source and yet the sound from this source continues to be presented to him preferentially. Optionally, the selection operation can be fully automated by a source being selected automatically if it is looked at for longer than a predetermined duration (e.g. 4 s) during its preferential presentation.

If no angle information is supplied by the BSS system, then there is nevertheless the possibility, as defined in a further embodiment, of the hearing instrument wearer looking, for the purposes of selection of a source of interest to him, in its direction (0° direction azimuth =direction of view). It is a precondition in this case that a highly selective directional microphone M is operating at the same time in the hearing instrument, which microphone M only receives sound from a very narrow range of angles around the 0° direction. By means of a control operation on the hearing instrument or on a device coupled to the hearing instrument, the hearing instrument is informed by pressing a button, by way of example, that the sound received by the directional microphone M is to be processed as useful sound. From the set of all sources that the BSS system has found, the useful source defined via the direction of view is selected automatically by means of correlation analysis, by way of example, and presented preferentially to the hearing instrument wearer. Following this "learning operation" also, the source no longer has to be looked at constantly.

The invention claimed is:

1. A hearing instrument, comprising:

a source separation device that:

receives a hybrid signal from a plurality of sound sources, generates a plurality of source specific signals from the hybrid signal, and provides associated receive angles of the source specific signals;

a presentation device that presents the source specific signals as a function of the associated receive angles; and a selection device that selects one of the source specific signals for further processing, wherein the selection device comprises a directional microphone so that the one of the source specific signals is selected for further processing by aligning the hearing instrument to the corresponding specific sound source.

2. The hearing instrument as claimed in claim 1, wherein the selection device is wirelessly connected to the presentation device.

3. The hearing instrument as claimed in claim 1, wherein the selection device is integrated into a remote control device of the hearing instrument.

4. The hearing instrument as claimed in claim 1, wherein the selection device selects the one of the source specific signals for further processing by a user pressing a button on the selection device or knocking on the hearing instrument.

5. The hearing instrument as claimed in claim 1, wherein the presentation device presents the source specific signals one after another.

6. The hearing instrument as claimed in claim 5, wherein the source specific signals are presented in a predefined time sequence.

7. The hearing instrument as claimed in claim 1, wherein the selection device comprises a display unit to graphically display the source specific signals with respective to the associated receive angles.

8. The hearing instrument as claimed in claim 1, wherein the selection device selects the one of the source specific signals for further processing by aligning the hearing instrument to the corresponding specific sound source based on the corresponding associated receive angle provided by the source separation device.

9. The hearing instrument as claimed in claim 8, wherein the selection is performed automatically if the corresponding specific sound source is looked at by a user of the hearing instrument for longer than a predetermined time period.

10. The hearing instrument as claimed in claim 8, wherein the selection is performed semi-automatically by a user pressing a button when the corresponding associated receive angle of the specific sound source lies a 0° from a direction of view of the user.

11. A method for controlling a hearing instrument, comprising:

receiving a hybrid signal from a plurality of sound sources;

generating a plurality of source specific signals from the hybrid signal;

providing associated receive angles of the source specific signals;

presenting the source specific signals as a function of the associated receive angles; and selecting one of the source specific signals for further processing, wherein a directional microphone selects the one of the source specific signals for further processing by aligning the hearing instrument to the corresponding specific sound source.

12. The method as claimed in claim 11, wherein a user of the hearing instrument selects the one of the source specific signals for further processing by pressing a button or knocking on the hearing instrument.

13. The method as claimed in claim 11, wherein the source specific signals are presented one after another.

14. The method as claimed in claim 13, wherein the source specific signals are presented in a predefined time sequence.

15. The method as claimed in claim 11, wherein the source specific signals are graphically presented with respective to the associated receive angles.

16. The method as claimed in claim 11, wherein the one of the source specific signals is selected for further processing by aligning the hearing instrument to the corresponding specific sound source based on the corresponding associated receive angle.

17. The method as claimed in claim 16, wherein the selection is performed automatically after a user of the hearing instrument looks at the corresponding specific sound source longer than a predetermined time period.

18. The method as claimed in claim 16, wherein the selection is performed semi-automatically by a user of the hearing instrument pressing a button when a corresponding specific sound source lies in a 0° from a direction of view of the user.

* * * * *